US006238448B1

(12) United States Patent
Rouse et al.

(10) Patent No.: US 6,238,448 B1
(45) Date of Patent: May 29, 2001

(54) GRINDING STONES

(75) Inventors: Michael W. Rouse, Vicksburg, MS (US); Victor M. Deeb, Marlborough, MA (US)

(73) Assignee: R & D Technology, Inc., Vicksburg, MI (US)

( * ) Notice: Subject to any disclaimer, the term of this patent is extended or adjusted under 35 U.S.C. 154(b) by 0 days.

(21) Appl. No.: 09/375,134

(22) Filed: Aug. 16, 1999

(51) Int. Cl.[7] ..... B24D 18/00

(52) U.S. Cl. ..... 51/297; 51/295; 51/307; 51/293; 51/309; 51/298

(58) Field of Search ..... 51/295, 297, 307, 51/309, 293, 298; 451/539, 540, 544

(56) References Cited

U.S. PATENT DOCUMENTS

| | | | |
|---|---|---|---|
| 3,408 | 3/1844 | Arnold . | |
| 5,738 | 8/1848 | Kelsey . | |
| Re. 5,943 | 6/1874 | Belknap . | |
| 29,470 | 8/1860 | Davis . | |
| 52,015 | 1/1866 | Belknap . | |
| 616,160 | 12/1898 | Sturtevant . | |
| 3,326,480 | 6/1967 | Jones | 241/298 |
| 3,552,664 | 1/1971 | Herbert et al. | 241/260 |
| 3,684,200 | 8/1972 | Reinhall | 241/256 |
| 3,974,971 | 8/1976 | Reinhall | 241/261.3 |
| 4,005,827 | 2/1977 | Frair et al. | 241/261.3 |
| 4,036,443 | 7/1977 | Saltarelli | 241/297 |
| 4,351,489 | 9/1982 | Laptev et al. | 241/261.3 |
| 4,469,284 | 9/1984 | Brubaker et al. | 241/25 TR |
| 4,610,400 | 9/1986 | Sjöbom | 241/261.2 |
| 4,624,420 | 11/1986 | Pilao | 241/298 |
| 4,841,623 | 6/1989 | Rine | 29/525.1 |
| 5,238,194 | 8/1993 | Rouse et al. | 241/21 |
| 5,411,215 | 5/1995 | Rouse | 241/21 |
| 5,449,122 | 9/1995 | Berger et al. | 241/261.2 |
| 5,509,610 | 4/1996 | Gibbons et al. | 241/37 |
| 5,526,988 | 6/1996 | Rine | 241/23 |
| 5,564,634 | 10/1996 | Rouse et al. | 241/37 |
| 5,942,015 * | 8/1999 | Culler et al. | 51/295 |
| 5,958,794 * | 9/1999 | Bruxvoort et al. | 451/539 |

* cited by examiner

*Primary Examiner*—Michael Marcheschi
(74) *Attorney, Agent, or Firm*—Heller Ehrman White & McAuliffe LLP

(57) ABSTRACT

A grinding stone useful for a variety of comminuting applications, but especially useful for comminuting of rubber particles, comprises a cured mixture of a grit material (such as silicon carbide), an aqueous emulsion of an organic polymeric binding material, (such as an epoxy emulsion), a wetting agent, such as DAXAD™, a surfactant commercially available from the Hampshire Corporation of Lexington, Mass., and an inorganic binding material (preferably portland cement). The grinding stones can be prepared at room temperature, using readily available equipment, and at a greatly reduced cost when compared to current grinding stones prepared from silicon carbide and a vitrified ceramic binder. The stones of the present invention may be molded to a metal support plate, resulting in further process efficiencies and reduced stone manufacture and replacement costs.

15 Claims, 3 Drawing Sheets

GRINDING STONES

CROSS-REFERENCES TO RELATED APPLICATIONS

The following U.S. patent application is cited by reference and incorporated by reference herein: Application Ser. No. 09/314,040, titled "GRINDING DEVICES FOR RUBBER COMMINUTING MACHINES and assigned to the assignee of the present invention.

BACKGROUND OF THE INVENTION

1. Field of the Invention

The present invention relates generally to the field of comminuting devices and more specifically to grinding stones useful therein. Still more specifically, the present invention relates to grinding stones which may be made at ambient temperature from inexpensive material and using readily available equipment. In its most preferred embodiment, the present invention relates to grinding stones useful in rubber comminuting devices and which are used in pairs, are shaped as a torus and which include molded grooves on the confronting surfaces of the stone pairs, and which, in an alternative embodiment, are formed in situ with a steel support plate.

2. Description of the Prior Art

Comminuting devices of various types are widely known for a variety of uses, such as the milling of grain and the grinding of rubber scrap into fine powders. The latter have a variety of end use applications, e.g. in asphalt paving mixtures and in roofing compositions. In many of the grinding devices, including those discussed below, a pair of stones having abrasive flat faces are brought into proximity and one or more of the typically annular stones is rotated about its axis to abrade, shred, disintegrate, or tear the starting material into small pieces. Some processes are cryogenic, i.e. conducted at cold temperatures. Others are conducted at room temperatures, while still others are conducted in slurry form. No matter what process is used or what the ground material may be, a common and costly problem is the useful life of the stones. Obviously, the harsher the application, the shorter the stone lifetime. In any event, in nearly all grinding operations, the cost of grinding stones and the downtime cause by the frequent repair or replacement thereof has a major financial impact on overall process profitability, efficiency, and in some cases even on process viability. The problems just discussed exist today in the rubber comminuting field where margins need to be carefully controlled and where grinding stone replacement and downtime costs represent a very substantial portion of the overall process economics.

A considerable amount of prior art describes grinding machines which can be used to grind material between abrasive grinding stones. Recently, the stones and plates on which they are mounted have been improved so that they may be rotated at higher speeds, thus permitting higher production rates and a much broader range of applications. Operational speed had previously been limited because of the low resistance of the stone to centrifugal and thermal stresses. Thermal stresses are induced when heat is generated by the grinding operation itself. For many applications, such as reducing rubber, plastic or wood material, abrasive grinding stones are preferable to metal discs which are both expensive and suffer additional disadvantages for these particular end use applications. Further background on early stone mounting techniques is contained in U.S. Pat. No. 4,841,623 issued to Rine on Jun. 27, 1989 and titled METHOD OF MOUNTING STONES IN DISC OR ATTRITION MILLS. The disclosed techniques include the use of molten sulfur, lead or other molding material deposited between a flange of the grinding wheel and the wheel itself, the wheel being slightly enlarged in diameter so that the molten material can hold it in place.

Another technique described in the aforementioned Rine patent uses a layer of specially processed material, usually rubber, to act as a cushion between the stone and its backing plate to relieve grinding strains and shocks. However, where heavy stress and torque loads are encountered, wire or other suitable binding is needed on the outside diameter of the stone.

Grinding wheels have also been found to be of greater benefit than cryogenic hammer-mill techniques which freeze elastomeric particles and crush them while they are in a frozen condition. Wet grinding is a process which has been developed and is described in early patents, such as British Patent No. 1,516,090 to Robinson, et al. and in a series of patents owned originally by The Goodyear Tire & Rubber Company of Akron, Ohio and exemplified by U.S. Pat. No. 4,469,284 issued to Brubaker et al. The method described therein uses abrasive stones, acting on a rubber particle/water slurry.

Most of the prior comminuting machines utilize vertical grinding machines in which a pair of opposed grinding stones are arranged with their horizontal surfaces facing each other. The top stone is typically fixed in place and the bottom stone is mounted on a motor arranged to rotate it about a vertical axis. Both stones have hollow centers and grind material between the mating faces of the stones which are formed like a flat torus. The material is introduced as a slurry through an opening in the top stone to an open center space formed between the center of the two stones. The slurry passes between the two opposing faces during the grinding process, and the ground slurry is collected in a collection region outside the outer rim of the stones. It is then processed by further steps of screening, drying and the like.

One of the present inventors has previously made several additional contributions to this art. For example, U.S. Pat. No. 5,238,194 issued to Rouse et al. on Aug. 24, 1993 titled METHOD OF PRODUCING FINE ELASTOMERIC PARTICLES describes a procedure in which the rate of flow of carrier liquid is established at a desired pressure when the stones are closed, thereby establishing a maximum flow rate of carrier liquid. The slurry is then fed at a flow rate equal to that established for the carrier fluid alone, whereby the gap between the two grinding stones will remain substantially constant and the production rate of ground material will be optimized.

Other techniques, including some of those described in various patents issued to Brubaker, involve the use of hydraulic means to set the spacing between the stones, while other companies have used mechanical devices to set the stone spacing.

Another contribution made by the assignee of the present invention is two-stage grinding, in which finer particles are produced by a two step process. See U.S. Pat. No. 5,411,215 issued May 2, 1995 to Rouse titled TWO STAGE GRINDING. The feed from the feed stock is first transported through stones to produce a −30 to −40 mesh product in a single pass, and water is then added to the resultant product and transported back through a second grinding stage to produce an average of −80 mesh powder.

A still further advance in this art is disclosed in U.S. Pat. No. 5,564,634 issued on Oct. 15, 1996 to Rouse et al. titled RUBBER COMMINUTING APPARATUS. In this device, instead of using stones mounted for rotation about a vertical axis, rotation around a horizontal axis is employed. Furthermore, the device described in the preferred embodiment of this patent includes two vertically mounted grinding stones which do not rotate and which are spaced apart from one another to act as stators. Located between them is a pair of outwardly facing rotor stones. The spacing between the opposed sets of grinding stones is established by increasing or decreasing the spacing between the stators, and while the rotors rotate for grinding, the floating center stones will position themselves equally between the two stators so as to equalize the dynamic slurry pressure imposed during the grinding process upon the faces of the stone.

The particular grinding stones used in such processes have also been described in the aforementioned '634 patent. The stones themselves have various grit sizes established by known techniques, and the mounting of them to the various support plates is also described in this patent. A preferred mounting technique is that described in the aforementioned Rine patent where grinding discs are placed under a compressive load sufficient to counter the tension loads during use. Preferably the compression loading is provided by taper elements incorporating the wheels themselves or by taper elements other than the wheels, such as fluid actuated clamps and elements external to the wheels that induce the compression. Examples of each are shown in FIGS. 1 and 2 of the Rine patent. The Rouse et al. '634 patent also describes an inherent disadvantage in the Rine system. Namely, because of the clamping structure used to counter the tension loads, the stones may only be used until they are worn down to the upper surface of the clamping members. At this point, the stones must be replaced. Adhesive mounting of stones, permitting the stone to be ground essentially down to the level of the stator can nearly double the life of the stone. While adhesive binding of the stones to the mounting plates is referred to in this patent, no examples are provided of suitable systems, and, to the knowledge of the present inventor, no suitable commercial systems based upon the use of adhesives alone to bind the stone to the backing plates are in commercial operation.

Grinding stones used in the aforementioned systems typically include silicon carbide as the grit material and a vitrified ceramic binder. Such stones are expensive, especially in situations where only a portion of the stone thickness is utilized (e.g., in systems where a mechanical stone containment system) such as that described in the Rine '623 patent, is used. The cost of the stones is due in large part to the cost of stone ingredients and to the cost of the energy required to melt the ceramic binder and to apply pressure to the stones during their molding processes.

Less expensive grinding stones, especially ones which retain grinding properties similar to those currently in use, would represent a very significant advance in the particle comminuting art.

FEATURES AND SUMMARY OF THE INVENTION

A primary feature of the present invention is an inexpensive grinding stone which may be used in the aforementioned grinding processes, including the comminuting of rubber scrap into fine mesh rubber powders.

Another feature of the present invention is to provide an inexpensive grinding stone which may be made at ambient temperature and pressure using relatively inexpensive starting materials in commonly available and inexpensive mixing equipment.

A different feature of the present invention is the formation of a grinding stone and support plate combination in a single manufacturing step to reduce stone maintenance and replacement costs.

A further feature of the present invention is to provide a long lasting grinding stone which may be easily molded and which may be made in a large variety of shapes and grit sizes.

How these and other features of the present invention are achieved will be described in the following detailed description of the preferred and an alternate embodiment. Generally, however, they are accomplished by manufacturing a grinding stone from three major components and lesser amounts of other materials added to enhance the manufacturability of the stones and the quality of the performance thereof. The first major component is a grit material, such as silicon carbide of a preselected average particle size. The second major component is an aqueous emulsion of a polymeric binding material, such as an epoxy binder. The third major component is an inorganic binding material, preferably portland cement. These components are mixed, and sufficient water is added to provide a workable and moldable final product. Mixing aids such as Daxad™, commercially available from Hampshire Corporation of Lexington, Massachusetts, is added to enhance the mixing. The mix is molded into a desired shape, such as a flat-faced ring or torus, and in the alternate embodiment a supporting metal plate is embedded in the stone mix. The mix is allowed to fully cure, for about twenty seven (27) days at room temperature or faster if various acceleration techniques are used, such as those already known in the cement curing art. The mixing and molding equipment can be simple in construction and inexpensive in cost, and the resulting cured stones have grinding efficiencies and useful lives similar to those of the much more expensive carbide and ceramic stones currently in use. Other ways in which the features described above and other features can be accomplished will appear to those skilled in the art after they have read the following portions of this specification. Such other ways are deemed to fall within the scope of the present invention if they fall within the scope of the claims which follow.

The present invention relates to a method of making a grinding device. The method includes mixing a binding material, a grit material, and a wetting agent to form a slurry. The method also includes molding the slurry into a preselected shape. The method further includes curing the slurry. The method still further includes affixing the cured slurry to a baseplate with an adhesive. Also, the method includes curing the adhesive.

The present invention further relates to a method of forming a baseplate in situ with a grinding portion. The method includes mixing a binding material, a grit material and a wetting agent to form a slurry. The method also includes molding the slurry into a preselected shape. The method further includes embedding a baseplate in the slurry. Also, the method includes curing the slurry.

The present invention further relates to a grinding device made by the process of mixing a binding material, a grit material and a wetting agent to form a slurry. The process includes molding the slurry into a preselected shape. The process also includes curing the slurry. The process further includes affixing the cured slurry to a baseplate with an adhesive material. Also, the process includes curing the adhesive material.

DESCRIPTION OF THE DRAWINGS

In the various FIGURES, like reference numerals are used to denote like components.

DETAILED DESCRIPTION OF THE PREFERRED EMBODIMENTS

Figure 1:
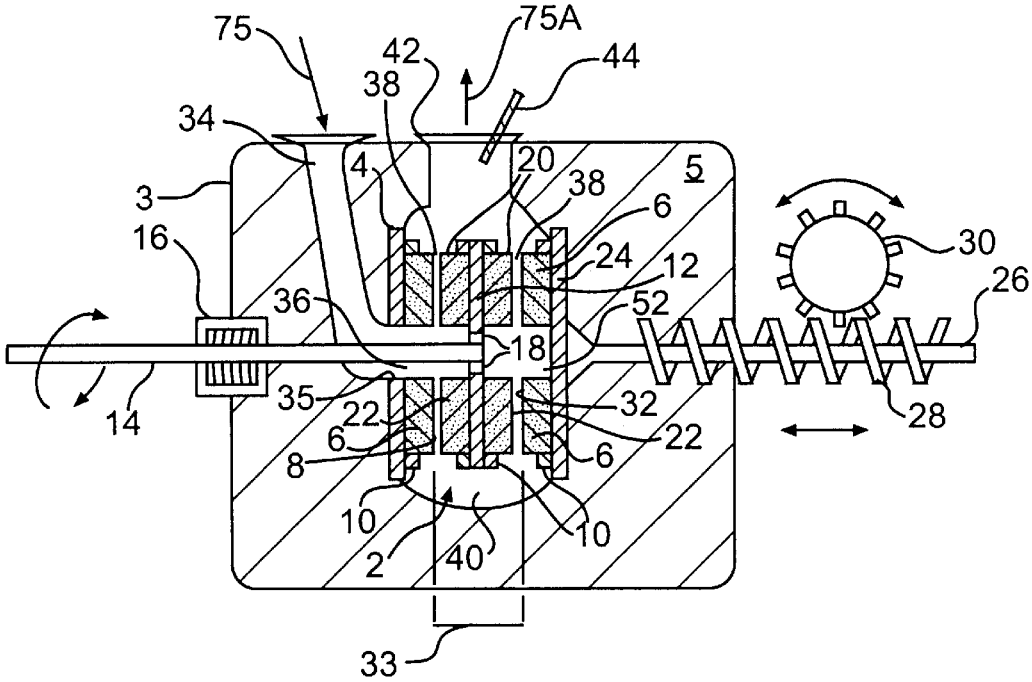
FIG. 1 is a cross-sectional view of a grinding machine utilizing grinding stones according to the prior art.

Before proceeding to the detailed description of the preferred and alternative embodiments of the invention, several general comments can be made about the applicability and the scope of the invention.

First, a majority of this specification and drawings relate to rubber comminuting, which is the primary business of the assignee of the invention. However, it should be understood that the grinding stones of the present invention can be used for a variety of other industrial or agricultural purposes, such as grinding and milling of natural or process foods, grinding of plastics, grinding and finishing of various surfaces, such as flooring, wood, plaster, plastic, metal or metal alloy surfaces, and the like.

Second, while the drawings show grinding stones especially useful for ambient temperature grinding of aqueous slurries of rubber chunks or particles into fine mesh powders, the stones may be used in cold or hot applications and in non-slurry applications of all types.

Third, the grinding stones illustrated are all shown with metal backing plates, such as those used to rotate one of a pair of stones in the aforementioned rubber comminuting devices. However, the grinding stones may be used in applications where rotation is not employed (e.g. where reciprocal or other grinding forces are imparted on an object or plurality of objects) and in applications where the stones are received in, attached to or otherwise incorporated in a grinding device or machine other than through the use of a metallic support plate.

Fourth, the shape and size of the grinding stones of the invention can be widely varied. In other words, the stone need not be annular. They many be smaller or larger, and thicker or thinner than the stones illustrated for use in rubber comminuting devices, which in many cases are about twenty to thirty-six (20–36) inches in diameter.

Fifth, the individual components for making the grinding stones of the present invention may be modified from the most preferred components described below and used in the working example. General categories are specified and will control the choices, but within each category a wide variety of choices will exist for those skilled in the art who read and understand this specification. For example, the inert grit material can be other than the preferred silicon carbide, including such diverse materials as ceramics, chips, industrial grade diamonds, sand, diamond dust, garnet, sand (silica), corundum (aluminum oxide, emery), pumice, rouge (iron oxide), feldspar, boron carbide, cerium oxide, and fused alumina, and other natural or synthetic compounds or elements which can serve the anticipated grinding function. Similarly, the aqueous of a polymeric binder emulsion is preferably an epoxy emulsion, but other classes of polymeric emulsions may be used to bind the grit material and the inorganic binding material, for example silicone emulsions, acrylic emulsions, polyurethane emulsions, polycarbonates and the like can be used, and the emulsions need not be aqueous if compatibilizers are used so that the binding material and the inorganic material can cure properly to hold the grit in an evenly dispersed condition. In addition, DAXAD™, a surfactant well-know in the art commercially available from Hampshire Corporation of Lexington, Massachusetts is referred to in the working example, primarily to reduce the amount of water required to make a workable and moldable mixture with the portland cement. Other wetting agents having similar properties, such as other soaps and alcohols can be used. Finally, portland cement is the preferred inorganic binding material because of its great strength, its availability and its low costs. But other inorganic cements, such as hydraulic cement, sintered high alumina cement, fused high alumina cement, etc. can be substituted therefor.

Figure 2:
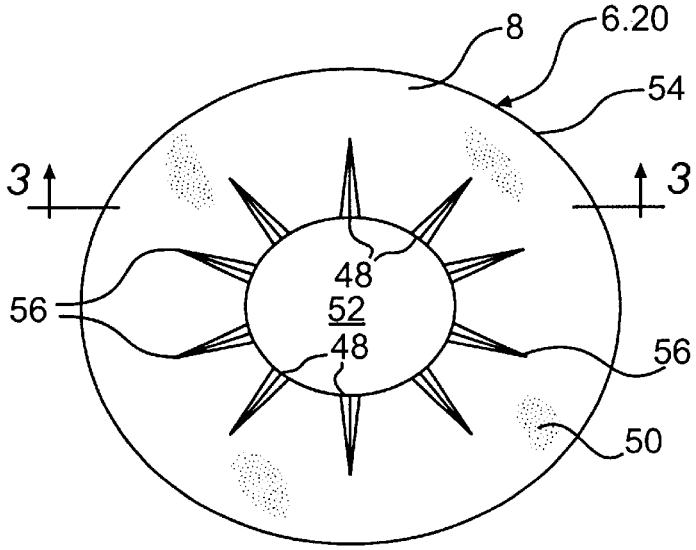
FIG. 2 is a face view of a typical abrasive grinding stone used with the device shown in FIG. 1.
Figure 3:
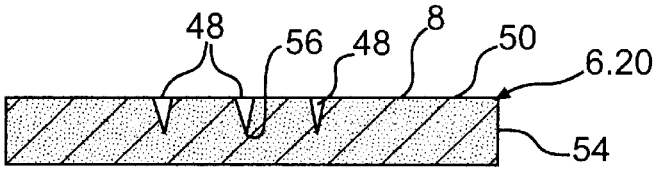
FIG. 3 is a sectional view taken along the line 3—3 of FIG. 2.

Proceeding now to a description of the present invention, a preferred apparatus in which the stones of the present invention may be used will first be described. FIGS. 1–3 illustrate the prior art of the Rouse et al. '634 patent, assigned to the assignee of the present invention. FIG. 1 shows in cross-section a double disc grinder which comprises a casing 3 and a strong, steel housing having a hinged end section 5 which can be swung away to open the interior of casing 3 for inspection, removal or maintenance of the interior mechanism described below.

Within casing 3, against an interior wall thereof, is mounted a first fixed stator 4 comprised of a flat, metal plate fixedly mounted to casing 3 and having a central bore or opening 35 in the center thereof. Mounted to the stator 4 is a stator abrasive stone 6. Each of the abrasive stones described herein is of the form shown in FIGS. 2 and 3. These are unitary, composition stones made of sintered or formed abrasive grit material and are shaped like an open-centered flat faced torus. A center bore 52 provides an opening within the center of each stone. Along an inner circumference of the stone are a series of stone grooves 48, each generally triangular in shape and narrowing to a point 56, although the exact shape of the groove is not considered critical. The grooves do not extend for the entire radius of the grinding stone, but rather end at an intermediate point between the center bore 52 and an outer edge 54 of the stones. The remaining outer face 50 of the grinding stone is flat, and forms the surface of the stone where most of the actual grinding will take place.

The grinding operation is carried out according to this prior art teaching by placing an identically formed stone in face-to-face by spaced apart relationship with the abrasive stone, the latter being rotated to create a grinding action. Stator abrasive stone 6 is mounted to stator 4 by means of a stone mounting clamp 10, a suitable clamp being that described in the aforementioned Rine '623 patent.

Within a hinged end section 5 of casing 3 is also mounted a movable stator 24. Moveable stator 24 is mounted to a shaft 26 which moves inward or outward with respect to hinged end section 5, permitting placement of moveable stator 24 away or toward stator 4. Any suitable method may be used for moving movable stator 24. In the illustration, a shaft tooth section 28 is provided upon moveable stator shaft 26. A stator positioning gear 30, driven by a hand crank or an electric motor, engages with tooth section 28 on stator shaft 26 to move moveable stator 24 inward or outward with respect to fixed stator 4.

Moveable stator 24 has in inward face 32. On face 32 a second stator abrasive stone 6 is mounted in the same manner as stator abrasive stone 6 is mounted to fixed stator 4. When so mounted, both stator abrasive stone 6 mounted to fixed stator 4 and stator abrasive stone 6 mounted to moveable stator 24 are facingly opposed to one another with a space 33 therebetween.

In space 33 between stator abrasive stones 6 is mounted a floating rotor 12, which is a steel disc rotor mounted on a floating shaft 14. The latter is supported by a moveable rotor shaft seal 16 within casing 3 for both rotary and lateral movement. Any one of a number of well-known floating drives permits such a rotor to rotate freely and yet freely slide in and out of casing 3. Such drives are well-known in the art and are not shown here. A suitable drive is identified as "DD 4000", or "THE TWIN HYDRADISK REFINERM™, a known floating drive machine" sold by Black Clausen of Beloit, Wis. (commonly used in the pulp and paper industry).

Mounted to the rotor 12 are two rotor stones 20. Rotor stones 20 are of identical construction to stator abrasive stone 6 and are mounted back to back to rotor 12 so that rotor stone faces 22 are facing and opposed to the fixed stone grinding face 8 and moveable stator grinding face 32.

An inlet pipe 34 provides a slurry 75 of rubber particles and water to be ground and is mounted externally to casing 3, passes through casing 3 and provides a channel for the flow of slurry 75 through bore 35. From there slurry 75 flows into a central open gap 36 formed by center bores 52 of the grinding stones. Suitable openings or passages 18 are positioned within the center of rotor 12 to permit a free flow of slurry throughout gap 36. The facingly opposed stator and rotor stones 4, 20 are opposed face-to-face. This provides for two parallel grinding passages 38, one between stator grinding face 8 and rotor face 22, another between stator face 32 and rotor face 22.

Depending upon the desired fineness of the grind, an optimum grit size can be selected and for a given grit size, an optimum spacing between the opposing grinding stone faces (i.e. for gap 36) can be determined. Techniques disclosed in the other patents mentioned in the background section of this specification may be used to make such determinations.

The optimum gap is experimentally determined to provide the best production rate for the desired rubber particle size for any given stone grit size. For a given rubber particle size, there is a distinct optimum gap at which the production rate for the desired rubber particle size peaks. The rate of production drops both for larger gaps, where the rubber is not so finely ground, and smaller gaps, where less rubber passes in a given time. A plot of the rubber production rate for the desired sieve size over a range of gap settings will show a single distinct production peak, which occurs at the optimum gap settings. It has also been discovered that as the stone grinding passage 38 is reduced in gap width, there is a steady increase in temperature through the double disc grinder 2. This is due to the increasing friction, and therefore energy is converted to heat as the gap is decreased. At a given grinding machine speed, the outlet temperature becomes a suitable indicator of the size of gap 36.

Around the outer edge of rotor stones 20 is a ground slurry collection chamber 40. Ground slurry collection chamber 40 connects to a slurry outlet pipe 42 passing ground slurry 75A to the exterior of the double disc grinder. A temperature sensor 44 is mounted within the slurry outlet pipe 42 to monitory the temperature of ground slurry 75A after it has passed through the double disc grinder. As indicated previously, additional details concerning the operation and use of the double disc grinder system described in connection with FIGS. 1–3 can be obtained from the aforementioned Rouse et al. '634 patent.

Proceeding now to a description of the present invention, different grinding devices are employed than those used in the prior art system. A grinding device according to the present invention is illustrated as reference numeral 100. Grinding device 100 includes an abrasive grinding portion 102 having a grinding surface 120 and a baseplate 106. Grinding portion 102 may include a binding material and a grit material. Grinding device 100 may have a central opening 110 and may include a plurality of grooves 112 extending from central opening 110. Grinding device 100 may be comprised of a plurality of arcuate segments 115, 116, 117 and 118, such as the segmented stones described in Ser. No. 09/314,040, titled GRINDING DEVICES FOR RUBBER COMMINUTING MACHINES which is hereby incorporated by reference in its entirety. An adhesive 125 may affix the segments at a line 113 and may affix grinding portion 102 to baseplate 106.

Figure 6:
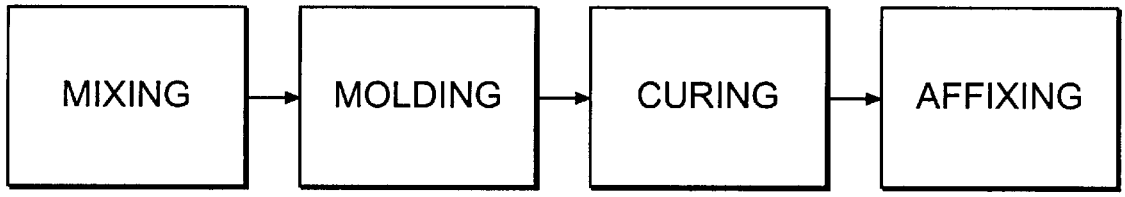
FIG. 6 is a process flow chart showing the manufacturing process for producing grinding devices of the present invention.
Figure 7:
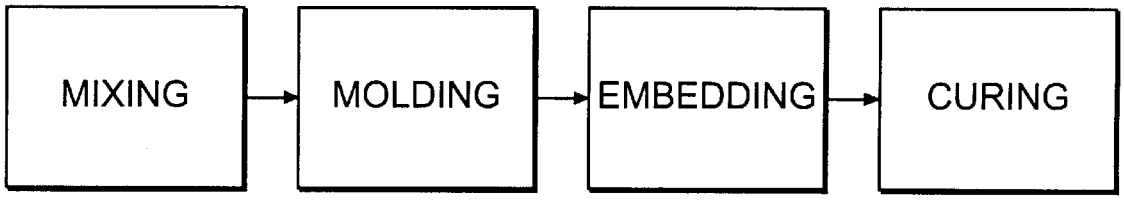
FIG. 7 is another process flow chart.

FIG. 6 shows that grinding device 100 may be produced in a single manufacturing step, according to an exemplary embodiment of the present invention. To produce grinding portion 102, the binding material, the grit material and a wetting agent are thoroughly mixed to form a slurry. The slurry is poured into a mold and is subsquently cured. Grinding device 102 is affixed to baseplate 106. The method for produing the grinding device does not require expensive equipment, and may be performed at ambient temperature.

The grit material may include an abrasive such as silicon carbide. The abrasive has the required hardness necessary to grind the subject matter of interest (e.g., rubber particles, grain, wood, etc.). The abrasive may have a preselected average particle size, preferably about the size of a grain of sand. According to an alternative embodiment, various sized particles (e.g., gravel, ¼" stone as is known in the paving art, crushed glass, etc.) may be employed as abrasives.

The binding material is preferably an inorganic binder such as portland cement. The binding material holds or glues the abrasive for subsequent grinding of a material of interest. A wetting agent, such as water, may be added to the grit material and the binding material to form a slurry. The wetting agent is added in an amount sufficient to allow suitable mixing. The slurry is mixed until the abrasive is dispersed substantially evenly throughout the binding material. After complete mixing, the slurry should have a slump of about eight inches and a water to portland cement ratio of about 0.4 in order to provide a workable and moldable product.

According to an alternative embodiment, a water reducing agent such as DAXAD™ commercially available from Hampshire Corporation of Lexington, Massachusetts or a humectant such as a polyhydric alcohol (e.g., glycerol, sorbitol, polypropylene glycol, glycerol, etc.) may be added to the slurry. The addition of the water reducing agent may allow for a higher content of the binding material and the grit material and a lower content of the wetting agent. Further, the water reducing agent may prevent settling and stratifying of the grit material in the binding material and may reduce slurry mixing times. According to a particularly preferred embodiment, DAXAD™ is used in the amount of about 12 ounces of DAXAD™ per 100 lbs. of portland cement, more preferably in the amount of about 9–11 ounces of DAXAD™ per 100 lbs. of portland cement. According to other alternative embodiments, a fluidizing agent such as fumed silica may be used.

The slurry may be provided in a mold of a desired shape, such as a flat-faced ring, a doughnut, or more preferably, the shape of a torus. The mold may be reusable and may be constructed of a pliable material such as wood, plastic, polyethylene, metal, etc. According to a particularly preferred embodiment, the mold is selectively compressible such that pressure may be applied to the mold.

The slurry may be cured to a hardened state capable of grinding the subject matter of interest. Sufficient hardening of the slurry may occur at room temperature after about two weeks. Curing may be accomplished over a shorter period if various acceleration techniques are used (e.g., curing chemicals or other techniques as those known in the concrete curing art). The time required for adequate curing of the slurry may be affected by atmospheric conditions, such as rain, temperature, humidity, etc. or by the amount of pressure applied to the mold. According to a particularly preferred embodiment, the curing is complete after about twenty-seven (27) days at ambient temperature. A cured slurry should form a grinding portion having a suitable compressive strength, such that the integrity of the grinding portion remains intact during the grinding operation. According to a particularly preferred embodiment, the grinding portion has a twenty-eight day compressive strength of about 5400–6000 pounds per square inch. According to alternative embodiments, reinforcing materials, such as wire mesh or steel reinforcing bars may be provided in the slurry during curing to increase the strength and durability of the grinding portion. According to other alternative embodiments, the slurry may be molded into a random, non-random, or prefabricated shape, which may be cut, tapered or ground to the appropriately desired shape during or after curing. According to an alternative embodiment, a curing agent is used to accelerate curing of to the slurry. According to other alternative embodiments, the curing agent may include microwaves, UV light, radiation, etc.

Grooves 112 may be provided on grinding portion 102 of grinding device 100. Grooves 112 have a depth that decrease in depth from central opening 110 of grinding portion 102 toward the circumferential edge of grinding portion 102. Grooves 112 may be formed during curing of the slurry by pressing a V-shaped member onto the surface of the slurry and then removing the V-shaped member. According to an alternative embodiment, before curing of the slurry, the grooves may be etched onto the surface of the grinding portion by an etching device such as a trowel. According to other alternative emobdiments, after curing of the slurry, the grooves may be etched onto the surface of the grinding portion by an etching device such as a saw, drill or chemicals (e.g., acids, bases, etc.,).

After the slurry has wholly or partially cured, the grinding portion may be removed from the mold and affixed to the baseplate by the adhesive. The baseplate may be constructed of a metal material, such as steel or other suitable materials (e.g., wood, plastic, ceramic, etc.). The baseplate may be cleaned before being affixing to the grinding portion. In some cases, the baseplate is treated (such as by sand or grit blasting) to increase the ability of baseplate to hold the adhesive thereupon.

The adhesive may include an adhesive selected from the classes of adhesives including epoxies, phenolics, acrylics, and other adhesives useful for bonding an inorganic binding material to a metal material. Curing or drying of the adhesive may be virtually instantaneous, or depending on the particular binding material employed, may require time to permit the binding material to form a satisfactory bond between the baseplate and the grinding portion. According to a preferred embodiment, the adhesive is an aqueous emulsion of a polymeric binder such as an epoxy binder.

After curing, the adhesive may be applied to either the grinding portion, to the baseplate, or to both the grinding portion and the baseplate. The adhesive may be a single component of adhesive that bonds upon drying, or a two part adhesive where one portion is applied to the backing plate and the other is applied to the grinding portion, or vice versa. An advantage of the using the adhesive to affix the grinding portion to the baseplate is that the adhesive may act as a force-absorbing layer when the grinding portion meets a stator stone. According to an alternative embodiment, each grinding portion may be separately formed and separately affixed to the baseplate and/or to each other. Such separate formation and affixing of the grinding portion may facilitate the manufacture of grinding devices of various shapes, sizes and configurations.

Figure 4:
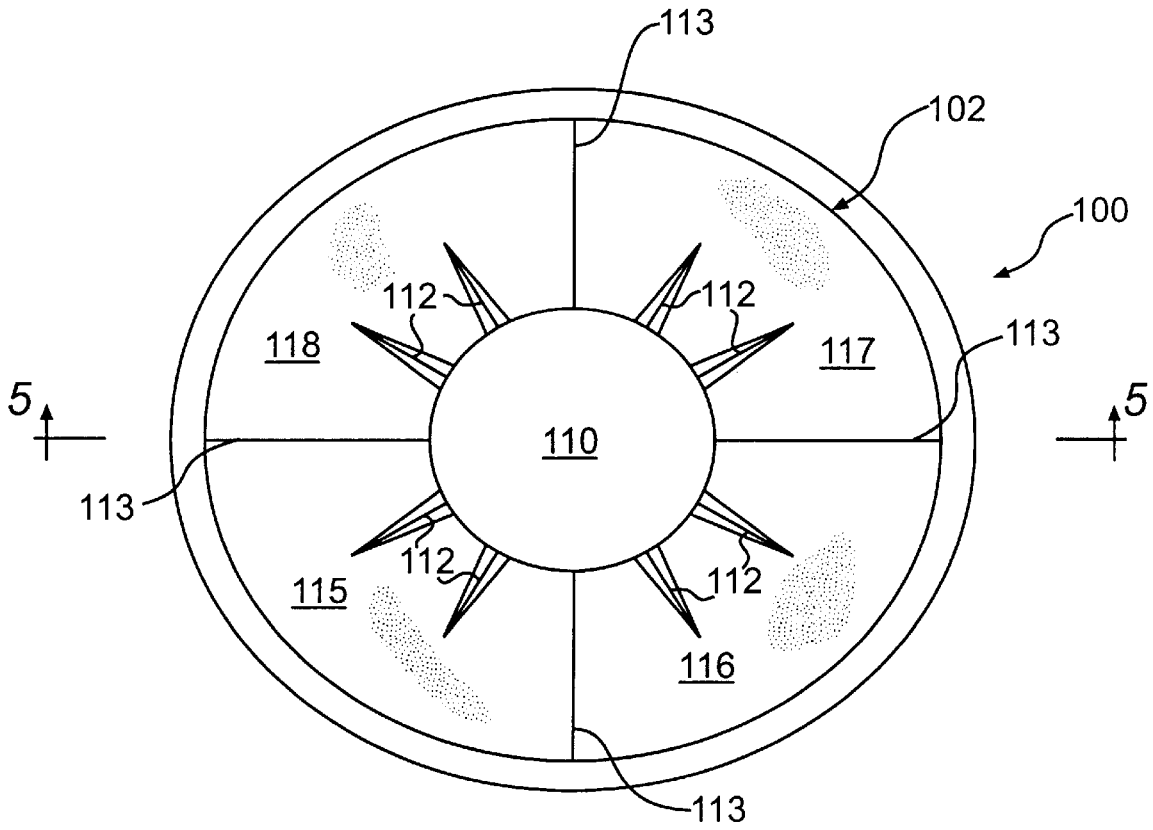
FIG. 4 is a top plan view of a segmented abrasive grinding device and baseplate according to an exemplary embodiment of the present invention.
Figure 5:
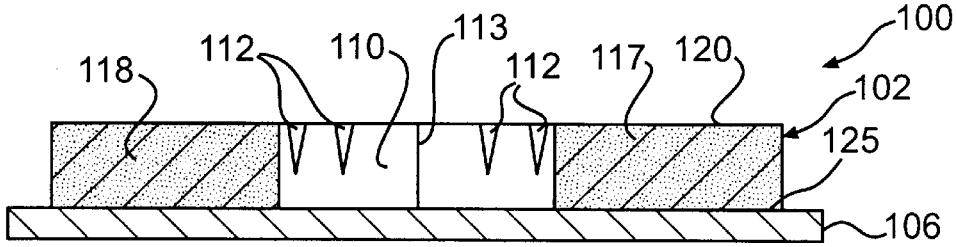
FIG. 5 is a sectional view taken along the line 5—5 of FIG. 4.
Figure 8:
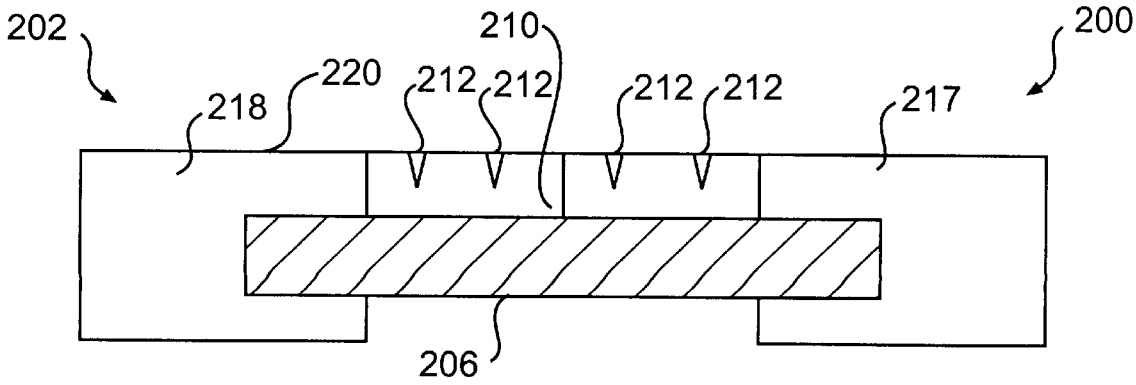
FIG. 8 is a sectional view, taken through a diameter of a grinding stone and embedded support plate made according to an alternative embodiment of the present invention.

FIG. 8 shows that a grinding device 200 may be produced in a single manufacturing step, according to an alternative embodiemnt of the present invention. Grinding device 200 includes an abrasive grinding portion 202 having a grinding surface 220 and a baseplate 206. Grinding portion 202, like grinding portion 102 of FIGS. 4 and 5, may include an inorganic binding material and a grit material. Grinding device 200 may have a central opening 210 and may include a plurality of grooves 212. Grinding device 200 may be comprised of a plurality of arcuate segments shown as segments 217 and 218. Grinding portion 202 differs from grinding portion 102 in that baseplate 206 is embedded in grinding portion 202 such that grinding portion 202 is positioned both above and below baseplate 206.

Grinding portion 202 may be manufactured in a manner similar to the manufacture of grinding portion 102, except that grinding portion 202 is formed in situ with baseplate 206 embedded in grinding portion 202. To produce grinding device 200, an inorganic binding material, a grit material and a wetting agent are thoroughly mixed to form a slurry. A water reducing agent, such as DAXAD™ may also be mixed in the slurry. The slurry is poured in a mold, which may be compressed, and cured at ambient temperature.

The mold for manufacturing grinding portion 202 may be similar to the mold for manufacturing grinding portion 102. According to an exemplary embodiment, a first portion of the slurry may be provided into the mold. Baseplate 206 (similar in shape, material and function to baseplate 106) may be floated on the first portion of the slurry. A second portion of the slurry may then be poured on baseplate 206 before substantial curing of the first portion of the slurry. According to an alternative embodiment, the baseplate may be elevated in the mold (e.g., by a protrusion supporting the baseplate in the mold) and the slurry may be poured in the mold such that the slurry surrounds both the top and the bottom of the baseplate in a single manufacturing step. The grinding portion may then be cured and removed from the mold, in a manner similar to the curing and removal of grinding portion 102.

EXAMPLE 1

A grinding portion may be manufactured and affixed to a baseplate. Portland cement in the amont of about 100 parts, silicon carbide in the amount of about 200 parts, water in the amount of about 40 parts, and "DAXAD™ a commercially available surfactant well-know in the art" in the amount of about 2 parts are mixed at ambient temperature in a mixer for about 5 minutes. The slurry may have a slump of about 8 inches and a water to cement ratio of about 40/100. The slurry is poured in a mold in the shape of a flat-faced torus. A curing accelerant commerically available from Grace Construction Products of Cambridge, Mass. is sprayed onto the slurry after 7 days of curing. The slurry is cured for about 28 days subject to atmospheric conditions in a covered state. The cured portion is then removed from the mold. Compression tests on the cured portion should show that the cured portion has a twenty-eight day compressive strength of about 5000 pounds per square inch. An epoxy adhesive is applied to the cured portion. The cured portion is then affixed to a sanded and primed steel baseplate and dried for about 24 hours.

EXAMPLE 2

A grinding portion may be manufactured in situ with a baseplate. Portland cement in the amont of about 100 parts, silicon carbide in the amount of about 200–400 parts, water in the amount of about 30–40 parts, and DAXAD™ in the amount of about 1–2 parts are mixed at ambient temperature in a mixer commercially available from Grace Construction Products of Cambridge, Massachusetts for about 5–10 minutes. The slurry may have a slump of about 8 inches and a water to cement ratio of about 0.3–0.4. The slurry is poured in a mold constructed of polyethelene in the shape of a flat-faced torus, which is supported by a steel baseplate. A vacuum is applied to the slurry. A curing accelerant commerically available from Grace Construction Product of Cambridge, Mass. is sprayed onto the slurry after 28 days of curing. The slurry is cured for about 28 days subject to atmospheric conditions in an uncovered state. The cured portion is then removed from the mold. Compression tests on the cured portion should show that the cured portion has a twenty-eight day compressive strength of about 5000–6000 pounds per square inch.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims. The order or sequence of steps, for example, may be varied or re-sequenced according to alternative embodiments of the invention.

What is claimed is:

1. A method of making a grinding device, comprising:

mixing a binding material, a grit material, and a wetting agent to form a slurry;

providing the slurry in a mold;

molding the slurry into a shape;

curing at least a portion of the slurry to form a cured portion;

affixing the cured portion to a baseplate with an adhesive;

curing the adhesive; and removing the cured portion from the mold.

2. The method of claim 2, wherein mixing further comprises mixing a water reducing agent with said binding material, said grit material and said wetting agent.

3. The method of claim 2, wherein the water reducing agent is a surfactant.

4. The method of claim 3, wherein the binding material is an inorganic cement.

5. The method of claim 3, wherein the binding material is portland cement.

6. The method of claim 3, wherein the grit material is silicon carbide.

7. The method of claim 6, wherein the adhesive is selected from the group consisting of silicone emulsions, acrylic emulsions, polyurethane emulsions, and polycarbonates and combinations thereof.

8. The method of claim 6, wherein the adhesive is an epoxy.

9. A method of forming a baseplate in situ with a grinding portion, comprising:

mixing a binding material, a grit material and a wetting agent to form a slurry;

providing the slurry in a mold;

molding the slurry into a shape;

embedding a baseplate in the slurry;

curing at least a portion of the slurry to affix the slurry to the baseplate to form a cured portion; and removing the cured portion from the mold.

10. The method of claim 9, wherein the cured portion surrounds the baseplate.

11. The method of claim 10, wherein the grinding portion is in the shape of a torus.

12. The method of claim 11, further comprising mixing a water reducing agent with said binding material, said grit material and said wetting agent, and wherein the water reducing agent is a surfactant.

13. The method of claim 12, wherein the binding material is an inorganic cement.

14. The method of claim 12, wherein the binding material is portland cement.

15. The method of claim 14, wherein the grit material is silicon carbide.

* * * * *